United States Patent [19]

Wells, Sr. et al.

[11] Patent Number: 4,878,363

[45] Date of Patent: Nov. 7, 1989

[54] SUPER KOOLER

[76] Inventors: Francis E. Wells, Sr., 7823 Mandan Rd., Greenbelt, Md. 20770; George Spector, 233 Broadway RM 3815, New York, N.Y. 10007

[21] Appl. No.: 311,034

[22] Filed: Feb. 15, 1989

[51] Int. Cl.[4] ..... B67D 5/62

[52] U.S. Cl. ..... 62/400; 62/463; 62/529

[58] Field of Search ..... 62/400, 458, 463, 464, 62/457, 529

[56] References Cited

U.S. PATENT DOCUMENTS

| | | | |
|---|---|---|---|
| 206,128 | 7/1878 | Phillips | 62/463 X |
| 1,006,475 | 10/1911 | Gardner | 62/457 X |
| 1,572,242 | 2/1926 | McLaughlin | 62/400 X |
| 1,576,912 | 3/1926 | James | 62/400 X |
| 1,625,803 | 4/1927 | Haas et al. | 62/400 |
| 1,732,996 | 10/1929 | Wandel | 62/400 X |
| 2,144,177 | 1/1939 | Blomquist | 62/457 |
| 2,288,044 | 6/1942 | Stemme | 62/457 X |
| 2,468,661 | 4/1949 | Gladstone | 62/457 X |
| 3,059,452 | 10/1962 | Griffin | 62/529 X |
| 3,810,367 | 5/1974 | Peterson | 62/463 X |

*Primary Examiner*—Lloyd L. King

[57] ABSTRACT

A cooler device is provided which will keep ice in an insertable inner container from a beverage within an outer housing so as to prevent the beverage from becoming diluted when the ice melts.

3 Claims, 1 Drawing Sheet

SUPER KOOLER

BACKGROUND OF THE INVENTION

The instant invention relates generally to containers and more specifically it relates to a cooler device.

Numerous containers have been provided in prior art that are adapted to keep liquids therein in a cold condition until used. For example, U.S. Pat. Nos. 3,369,369; 3,696,633 and 4,255,944 all are illustrative of such prior art. While these units may be suitable for the particular purpose to which they address, they would not be as suitable for the purposes of the present invention as heretofore described.

SUMMARY OF THE INVENTION

A primary object of the present invention is to provide a cooler device that will overcome the shortcomings of the prior art devices.

Another object is to provide a cooler device which will keep ice in an insertable inner container from a beverage within an outer housing so as to prevent the beverage from becoming diluted when the ice melts.

An additional object is to provide a cooler device in which the insertable inner container can be simply removed so that additional ice can be placed therein to keep the beverage cool within the outer housing.

A further object is to provide a cooler device that is simple and easy to use.

A still further object is to provide a cooler device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
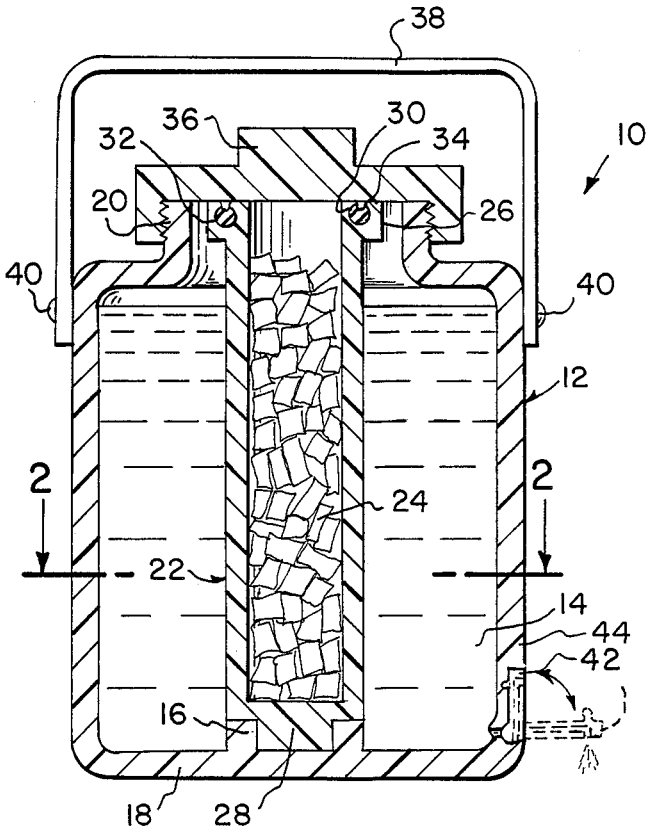
FIG. 1 is a vertical cross sectional view of the invention.
Figure 2:
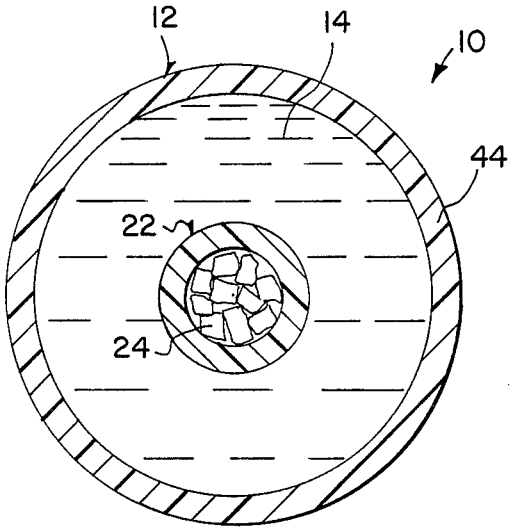
FIG. 2 is a horizontal cross sectional view taken along line 2—2 in FIG. 1.

Turning now descriptively to the drawings, in which similar reference characters denote similar elements throughout the several views, FIGS. 1 and 2 illustrate a cooler device 10 that consists of an outer housing 12 for holding beverage 14. The outer housing 12 has a seat 16 formed into center of bottom wall 18 and an externally threaded neck 20 formed in top end thereof. An inner container 22 is provided for holding ice 24. The inner container 22 has a mouth end 26 and a base end 28 and can be inserted within the outer housing 12 so that the base end 28 will fit into the seat 16. An O-ring 30 is carried in groove 32 on upper edge 34 of the mouth end 26 of the inner container 22. An internally threaded cap 36 is engageable with the externally threaded neck 20 and will bear against the O-ring 30 for sealing both the outer housing 12 and the inner container 22 thereby preventing the beverage 14 from becoming diluted when the ice 24 melts.

A handle 38 is affixed by rivets 40, to the outer housing 12 so that a person may carry the cooler device 10 thereby. A swivel spout 42 is carried on side wall 44 of the outer housing 12 near the bottom wall 18 so that the beverage 14 may be dispensed therefrom without removing the cap 36.

Figure 3:
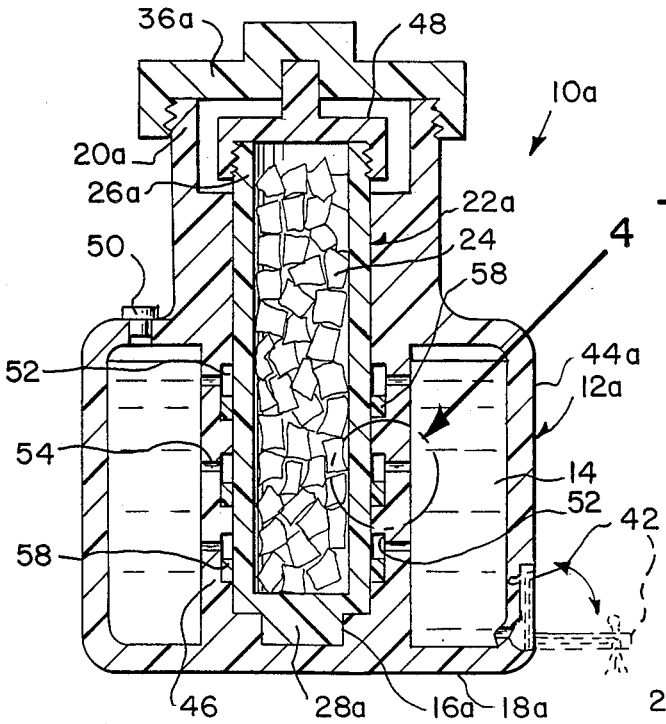
FIG. 3 is a vertical cross sectional view of a modification containing a sleeve having a plurality of slide valves which open when the insertable inner container is placed therein.

FIG. 3 shows a modified cooler device **10*a* that consists of an outer housing 12*a* for holding beverage 14. The outer housing 12a has a central sleeve 46 with a seat 16*a* formed into center of bottom wall 18 and an externally threaded neck 20*a* formed in top end thereof. An inner container 22*a* is provided for holding ice 24. The inner container 22*a* has an externally threaded mouth end 26*a* and a base end 28*a* and can be inserted within the sleeve 46 of the outer housing 12*a* so that the base end 28*a* will fit into the seat 16*a*. An inner internally threaded cap 48 is engageable with the externally threaded mouth end 26*a* for sealing the inner container 22*a*. An outer internally threaded cap 36*a* is engageable with the externally threaded neck 20*a* and will bear against the inner cap 48 for sealing the outer housing 12*a* and holding the inner container 22*a* within the central sleeve 46 thereby preventing the beverage 14 from becoming diluted when the ice 24** melts.

A filler cap 50 is disposed within upper portion of side wall **44*a* of the outer housing 12*a* so that the beverage 14 may be filled therein without removing the outer cap 36*a*. A swivel spout 42 is carried on the side wall 44*a* of the outer housing 12*a* near the bottom wall 18*a* so that the beverage 14 may be dispensed therefrom without removing the outer cap 36*a***.

Figure 4:
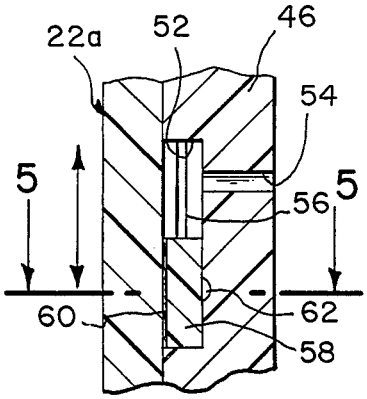
FIG. 4 is an enlarged detail view of one of the slide valves as indicated by numeral 4 in FIG. 3.
Figure 5:
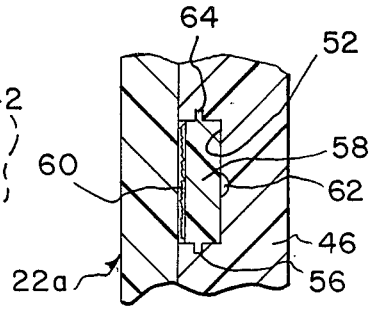
FIG. 5 is a cross sectional view taken along line 5—5 in FIG. 4 showing the tongue and groove tracks therein.

As best seen in FIGS. 4 and 5, the central sleeve 46 is fabricated out of highly thermally conductive material and has a plurality of inwardly facing slide tracks 52. Each of the slide tracks 52 has an upper aperture 54 therethrough and a pair of oppositely facing grooves 56 therein. A plurality of slide valves 58 are provided. Each valve 58 includes an inwardly facing soft compressible material layer 60, an outwardly facing button 62 and a pair of oppositely facing side tongues 64. The valves 58 are positioned within the slide tracks 52 so that the buttons 62 will engage with the upper apertures 54 to block passage of the beverage 14 therethrough. When the inner container **22*a* is inserted within the sleeve 46, as shown in FIGS. 3, 4 and 5, the inwardly facing layers 60 will make contact with the inner container 22*a* causing the valves 58 to slide down exposing the upper apertures 54 for allowing the beverage 14 to cool faster from the ice 24 within the inner container 22*a***.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A cooler device, comprising:

(a) an outer housing for holding a beverage, said outer housing having a central sleeve with a seat formed into center of bottom wall and an externally threaded neck formed in top end thereof;

(b) an inner container for holding ice, said inner container having an externally threaded mouth end and a base end and can be inserted within said sleeve of said outer housing so that said base end will fit into said seat;

(c) an inner internally threaded cap engageable with said externally threaded mouth end for sealing said inner container; and (d) an outer internally threaded cap engageable with said externally threaded neck and will bear against said inner cap for sealing said outer housing and holding said inner container within said central sleeve thereby preventing the beverage from becoming diluted when the ice melts.

2. A cooler device as recited in claim 1, further comprising:

(a) a filler cap disposed within upper portion of side wall of said outer housing so that the beverage may be filled therein without removing said outer cap; and (b) a swivel spout carried on said side wall of said outer housing near said bottom wall so that the beverage may be dispensed therefrom without removing said outer cap.

3. A cooler device as recited in claim 2, further comprising:

(a) said central sleeve being fabricated out of highly thermally conductive material having a plurality of inwardly facing slide tracks, each of said slide tracks havings an upper aperture therethrough and a pair of oppositely facing grooves therein; and (b) a plurality of slide valves, each including an inwardly facing soft compressible material layer, an outwardly facing button and a pair of oppositely facing side tongues, said valves positioned within said slide tracks so that said buttons will engage with said upper apertures to block passage of said beverage therethrough, whereby when said inner container is inserted within said sleeve, said inwardly facing layers will make contact with said inner container causing said valves to slide down exposing said upper apertures for allowing the beverage to cool faster from the ice within said inner container.

* * * * *